US005142826A

United States Patent [19]

Zhang

[11] Patent Number: 5,142,826

[45] Date of Patent: Sep. 1, 1992

[54] UNIVERSAL ABRADER

[76] Inventor: Chaoyin Zhang, 97 Construction Department of Huainan Coal Mining Administration, Anhui Province, China

[21] Appl. No.: 393,719

[22] Filed: Aug. 15, 1989

[30] Foreign Application Priority Data

Aug. 16, 1988 [CN] China ..... 88209886.1

[51] Int. Cl.[5] ..... B24B 23/00

[52] U.S. Cl. ..... 51/170 R; 51/177; 51/180

[58] Field of Search ..... 51/170 R, 176, 174, 51/177, 180

[56] References Cited

U.S. PATENT DOCUMENTS 3,975,055 8/1976 Wirtgen ..... 51/176

4,674,142 6/1987 Meili ..... 51/77

*Primary Examiner*—Maurina Rachuba

*Attorney, Agent, or Firm*—Reed Smith Shaw & McClay

[57] ABSTRACT

The present invention discloses a universal abrader capable of grinding, polishing, waxing, cutting (including groove and block cutting), and boring on surfaces having various shapes and tilting positions, for various architectural members. The abrader comprises a main body, a movable headstock supported movably on the main body; a rotatable arm supported rotatively on the movable headstock; a processing tool assembly mounted at the free end of the rotatable arm and carrying a rotatable processing tool; a driving mechanism for rotating the processing tool; a motion supporting mechanism for supporting the movable headstock on the main body and enabling the movable headstock with respect to the main body not only to rotate but also to displace in a direction perpendicular to a plane, in which, the processing tool rotates; a rotation supporting mechanism for supporting the rotatable arm on the movable headstock; and a walking mechanism mounted under the main body, for carrying the abrader to walk.

8 Claims, 5 Drawing Sheets

I
I
II
II
31
18
3
14
10
2
4
5
50
13
48
46
49
47

UNIVERSAL ABRADER

FIELD OF THE INVENTION

The present invention relates to an architectural fitting-up machine, and more particularly to a universal abrader capable of grinding, polishing, waxing, cutting (including groove and block cutting), and boring on surfaces having various shapes and tilting positions, for various architectural members, such as architectural members of concrete, terrazzo, marble, granite, metal and plastic, etc.

BACKGROUND OF THE INVENTION

For a long time in the architectural fitting-up process, people have usually used single-functional machines for the process of implemenation, such as wall surface abrader for grinding only wall surfaces (i.e. vertical or upstanding surfaces), floor surface abrader for grinding only floor surfaces (i.e. horizontal surfaces), cutting machine and boring machine, etc. It is easy to understand that so many special-purpose machines used in the process of implementation would cause a low utilization coefficient of such machines, a high cost of processing, and a long period of implementation.

In order to solve above-mentioned problems, the applicant of the present application disclosed in the Utility Model of Chinese Patent, No. 85200759 a multifunctional universal abrader capable of grinding, polishing, waxing, cutting (including groove and block cutting), and boring on surfaces having various shapes and tilting positions, for various architectural members. That abrader has a main body having a walking mechanism mounted thereunder and a movable frame which is hinged to the main body and can be rotated between vertical and horizontal limit positions. On the movable frame, there is a driving mechanism consisting of a electric motor and a speed reducing gear box, on the output shaft of which, a processing tool assembly is mounted and rotatively driven thereby. The processing tool assembly carried by the driving mechanism can be slid on a guide way constructed by U-steel, along the longitudinaly axis of the movable frame. In this way, the processing tool can be positioned on the processed surface by rotating the movable frame. While the processing tool is rotated, the driving mechanism and the processing tool assembly can be slid along the guide way of the movable frame, and the walking mechanism can be utilized to make the abrader walk, so that the entire surface to be processed can be treated continuously.

However, that abrader has the following drawbacks.

First, because the driving mechanism, i.e. the electric motor and speed reducing gear box, and the processing tool assembly are slid together on the movable frame, high power of the electric motor and high rotational speed of the tool are limited, otherwise, violent vibration and high noise would be produced. Therefore, that abrader is not fitted for the diamond tool which is suitable for working in the state of high power and high rotational speed, thus reducing the efficiency of the abrader.

Second, owing to heavy load of the movable frame, high rigidity is demanded, thus causing the excessively bulky movable frame and the main body which are not facilitate to operate and inconvenient to process inclined and horizontal surfaces.

Third, the rotational shaft carrying the processing tool to rotate cannot be moved in its axial direction, so that the feed rate and working pressure of a grinding head with respect to the grinding surfaces cannot be automatically regulated during grinding operation. Therefore, if the grinded surfaces are uneven, it is difficult to plane the concave portions; if the convex portions are completely grinded off until the concave portions become flat, the processing efficiency should be greatly reduced and processing qualities will also be lower.

SUMMARY OF THE INVENTION

The object of the present invention is to provide a small universal abrader which is capable of grinding, polishing, waxing, cutting (including groove and block cutting), and boring on surfaces having various shapes and tilting positions, for various architectural members and has high efficiency, good performance, wide applicability, and compact structure.

The abrader according to the present invention comprises: a main body; a movable headstock supported movably on said main body; a rotatable arm rotatively supported on the movable headstock; a processing tool assembly having a rotatable processing tool and mounted at the free end of the rotatable arm; a driving mechanism for rotating the processing tool; a motion supporting mechanism for supporting the movable headstock on the main body and enabling the movable headstock not only to rotate with respect to the main body but also to move in a direction perpendicular to a plane, in which, the processing tool rotates; a rotation supporting mechanism for rotatively supporting the rotatable arm on the movable headstock; and a walking mechanism mounted under the main body, capable of carrying the abrader to walk.

According to the present invention, by rotating the movable headstock, the processing tool can carry out operation on different surfaces (including vertical, horizontal, and inclined surfaces), and the feed rate of the processing tool can be controlled by moving the movable headstock in a straight line.

In the universal abrader of the present invention, the driving electric motor is mounted in the movable headstock, and rotates the processing tool through a belt transmission system. Then, a high power electric motor can be adopted to drive the processing tool to rotate at a high speed, and the detrimental vibration and noise caused by the abrader, especially the rotatable arm carrying the processing tool will not be produced. In this case, the diamond tool can be utilized to thereby enhance appreciably the processing efficiency.

According to another aspect of the present invention, the rotational tool shaft which carries the processing tool to rotate can be displaced in its axial direction, so that the processing tool (e.g. grainding head) can automatically adjust its own feed rate and working pressure when grinding uneven surfaces. This is extremely advantageous to the improvement of processing quality, increase of the life of the grinding head, and reduction of the vibration and working noise.

Moreover, in accoreance with the requirement, the universal abrader of the present invention can be provided with certain hand-held electric processing tools, such as hand-held-abrader, cutter, and hole-borer, etc, the power supplies of which are obtained from the electric power distribution box of the abrader, for processing small surfaces at edge or corner portions, which can not be touched by the processing tool of the abrader.

An preferred embodiment of the universal abrader according to the present invention will be described hereinafter in detail in connection with the accompanying drawings.

DETAILED DESCRIPTION OF THE PREFERRED EMBODIMENT

Figures 1, 2, 3, 4:
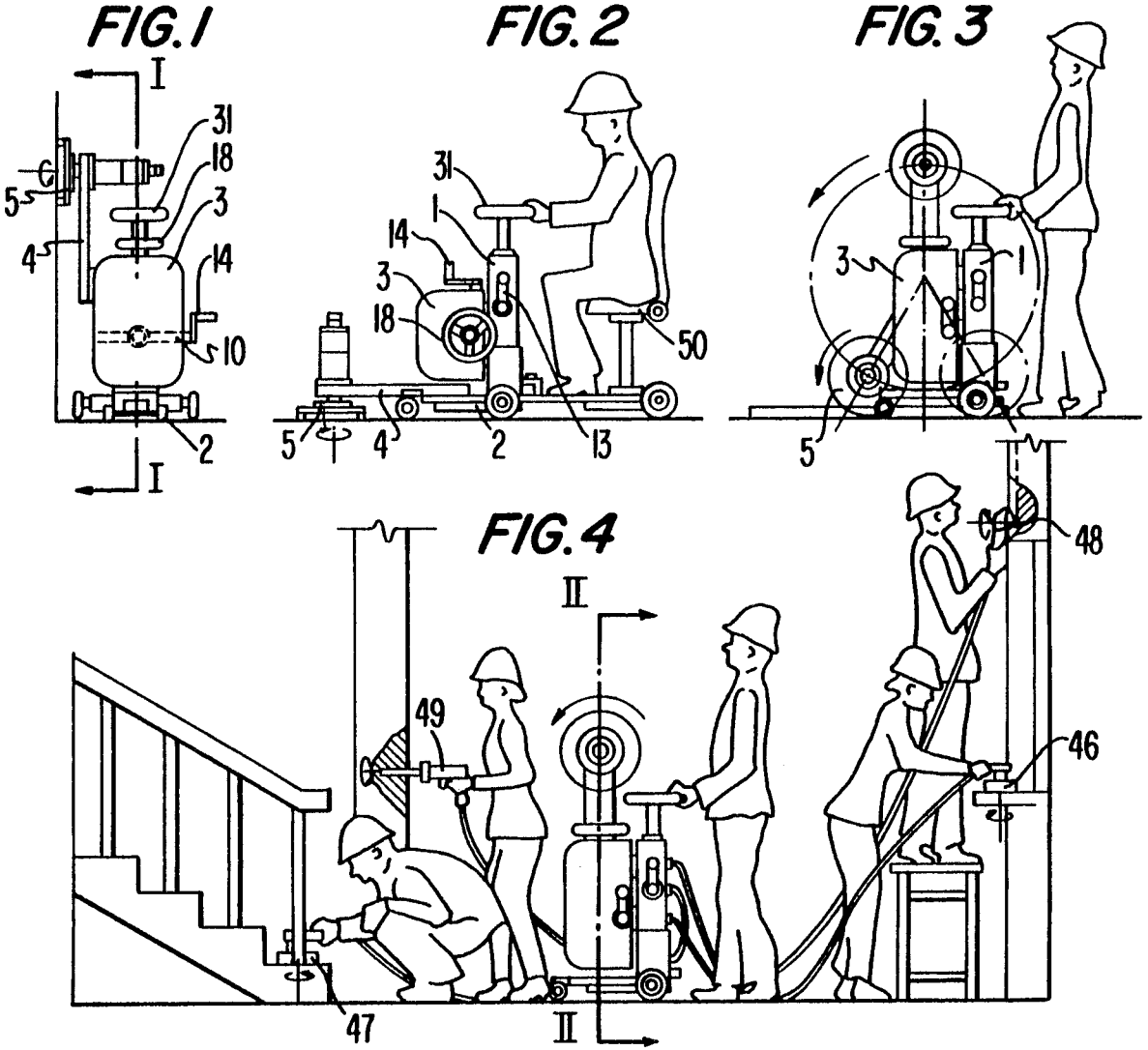
FIG. 1 is a schematically front view of the universal abrader according to the present invention, showing that a vertical wall surface is being grinded by the abrader.
FIG. 2 is a schematic side view of the universal abrader according to the present invention, showing that an operator is sitting on a seat pulled behind and by the abrader, and controlling the abrader to grind a horizontal floor surface.
FIG. 3 is a schematic side view of the universal abrader according to the present invention, showing the operator utilizing the abrader to cut the horizontal structrual member.
FIG. 4 shows a situation, in which, several operators utilize various hand-held electric processing tool to process speciall surfaces of small areas.

Referring first to FIGS. 1 and 2, reference numerals 1, 2, 3, 4 and 5 respectively designate a main body of the universal abrader of the present invention, a walking mechanism mounted under the main body 1, a movable headstock supported movably on the main body 1, a rotatable arm supported rotatively on the movable headstock 3, and a processing tool assembly which is mounted on the free end of the rotatable arm 4 and comprises a rotatable processing tool (i.e. a grinding head in this embodiment).

Figure 5:
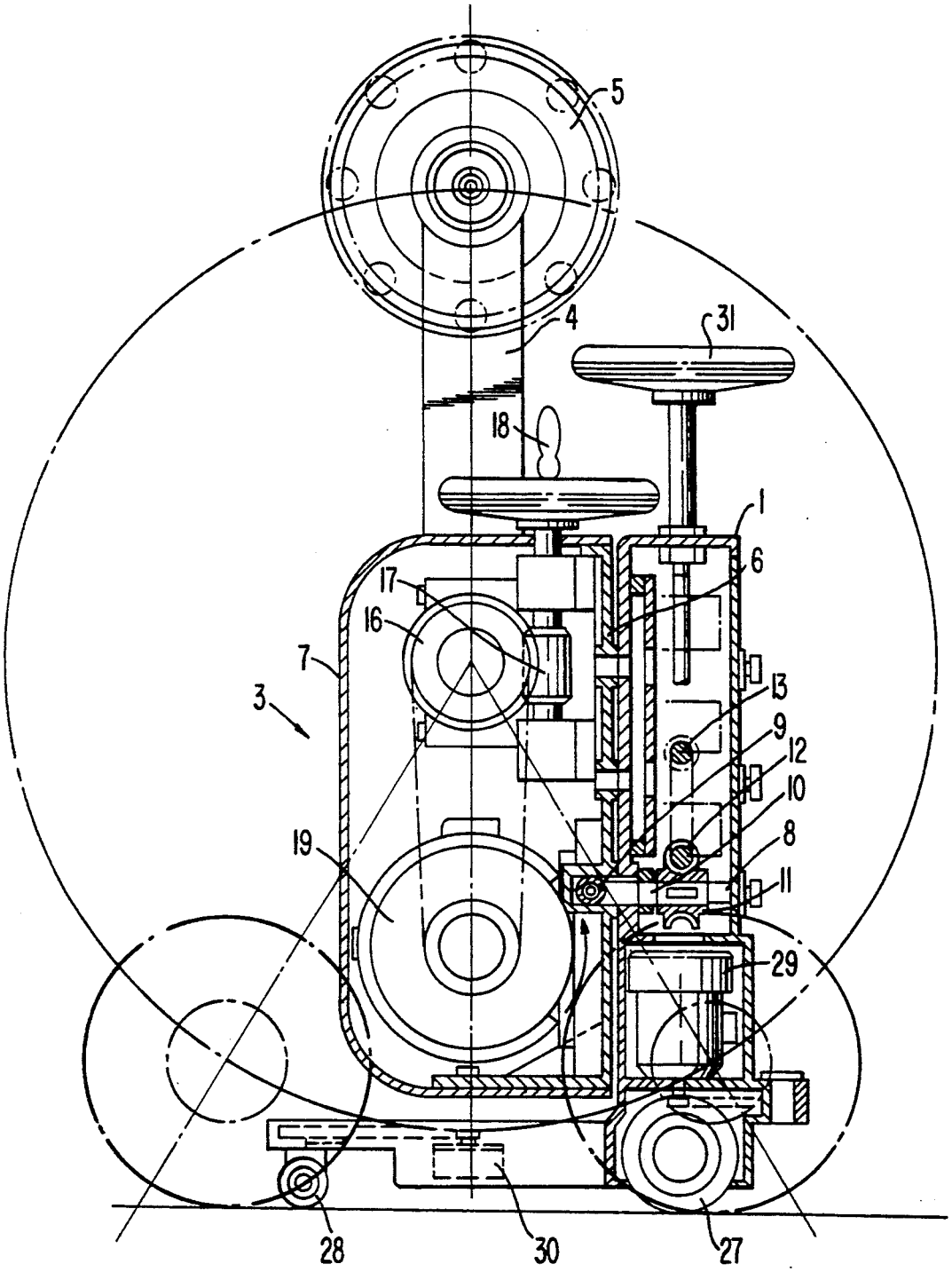
FIG. 5 is an enlarged sectional view taken along line I—I in FIG. 1.

Referring to FIG. 5, main body 1 is a upstanding box structure, and movable headstock 3 has a chassis 6 and a cover 7 connected to chassis 6. The chassis 6 is supported on the main body 1 by a motion supprting mechanism including a rotatable pivot 8 having an enlarged terminal head 9 which extends into chassis 6. Along a line perpendicular to the axis of prvot 8, there is a threaded hole in terminal head 9 (of course, terminal head 9 can be replaced by a screw nut). A screw stem 10 whose two terminals are mounted on the side walls of the chassis 6 is engaged with the threaded hole. Another terminal of pivot 8 is mounted in the main body 1. Hence, movable headstock 3 can be rotated relative to the main body 1 around the axis of the pivot 8. In order to enable the headstock 3 to stay stably at an arbitrary position rotated, a worm and worm-gear mechanism with self-lock performance can be used to rotate the headstock 3. For example, a worm-gear 11 can be fixed on the terminal of pivot 8, extending into the main body 1, and a worm 12 engaged with worm-gear 11 is disposed in the main body 1. By using a handle 13 connected with one terminal of worm 12 and mounted outside the main body 1, the rotation of worm-gear 11 can be controlled, thus carrying the headstock 3 to rotate. On the other hand, it can be understood that, by using a handle 14 (FIG. 1), screw stem 10 can be rotated to thereby carry the headstock 3, which is connected with screw stem 10 to be an integer, to displace in the axial direction of screw stem 10.

Figure 6:
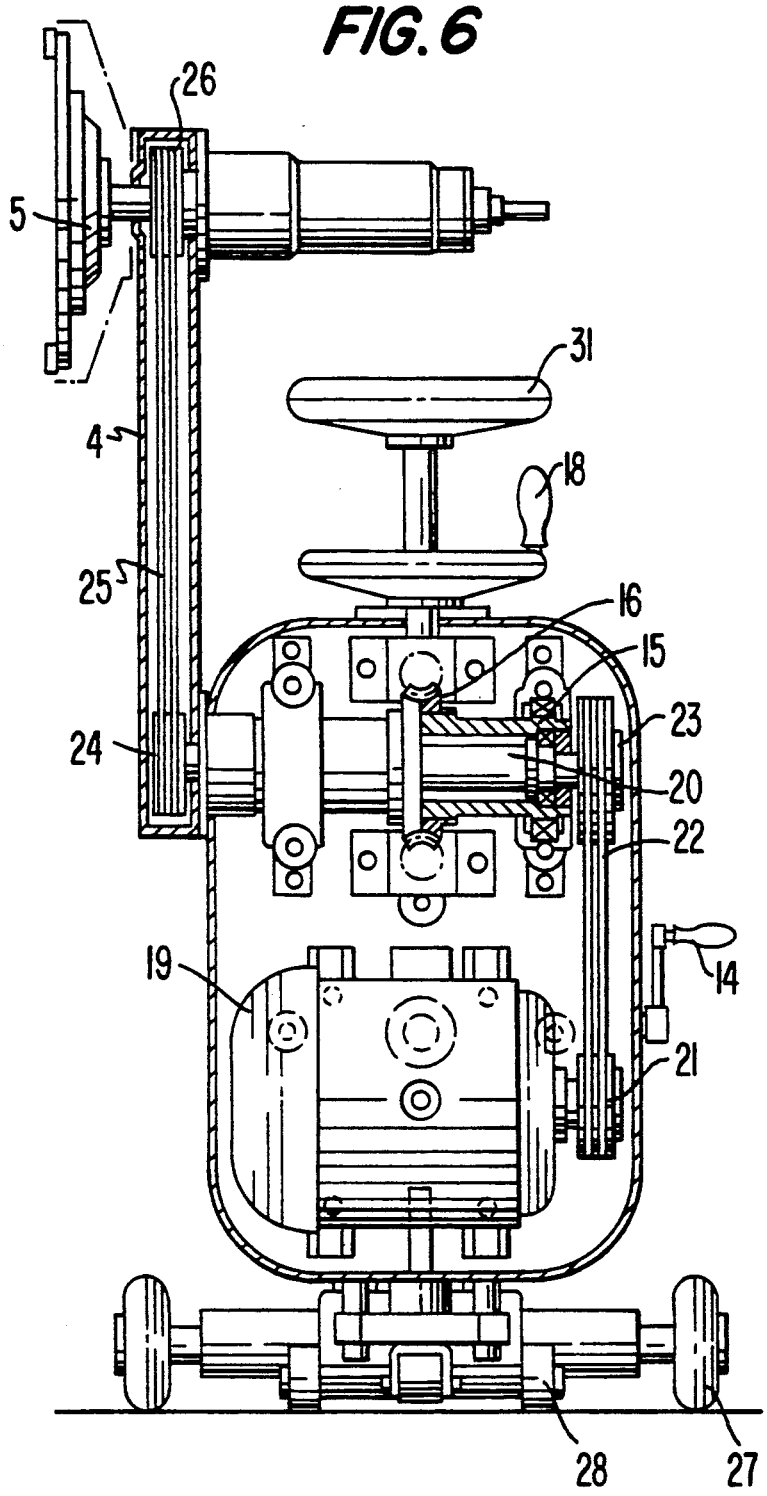
FIG. 6 is an enlarged sectional view taken along line II—II in FIG. 4.

From FIGS. 5 and 6, it can be seen that rotatable arm 4 is supported outside a vertical side wall of the headstock 3 by a rotatable shaft sleeve 15 horizontally mounted inside the headstock 3. The shaft sleeve 15 is fitted with a worm-gear 16 engaged with a worm 17 which can be rotated by a handwheel 18, as shown in FIG. 5. Thus, when worm 17 is rotated by handwheel 18, the processing tool assembly 5 mounted on the free end of rotatable arm 4 will rotate along a orbit shown in FIG. 5 as a dash and double dot line. Worm 17 may also be rotated by a speed reducing mechanism driven by an electric motor (not shown) to achieve the automatic rotation of the rotatable arm 4.

A main electric motor 19 is mounted on the chassis 6 of the headstock 3, and drives a intermediate transmission shaft 20 which is supported inside the shaft sleeve 15, through a pulley 21 mounted on the output shaft of the motor 19, transmission belts 22 and a pully 23 mounted on the input end of the shaft 20. The output end of the transmission shaft 20 extends in rotatable arm 4, and hence drives the processing tool to rotate through a pulley 24, transmission belts 25 and a pulley 26.

From FIGS. 5 and 6, it can also be seen that a walking mechanism 2 is mounted under the main body 1. In this embodiment, the walking mechanism 2 comprises a pair of walking wheels 27 and a pair of steering wheels 28. If it is desired that the abrader can automatically walk and steer, electric motors 29 and 30 and the corresponding speed reducing mechanisms can be utilized to drive walking wheels 27 and steering wheels 28, respectively. Alternatively, the manual steering of the steering wheels can also be achieved by a steering handle 31 and a corresponding transmission mechanism.

Figure 7:
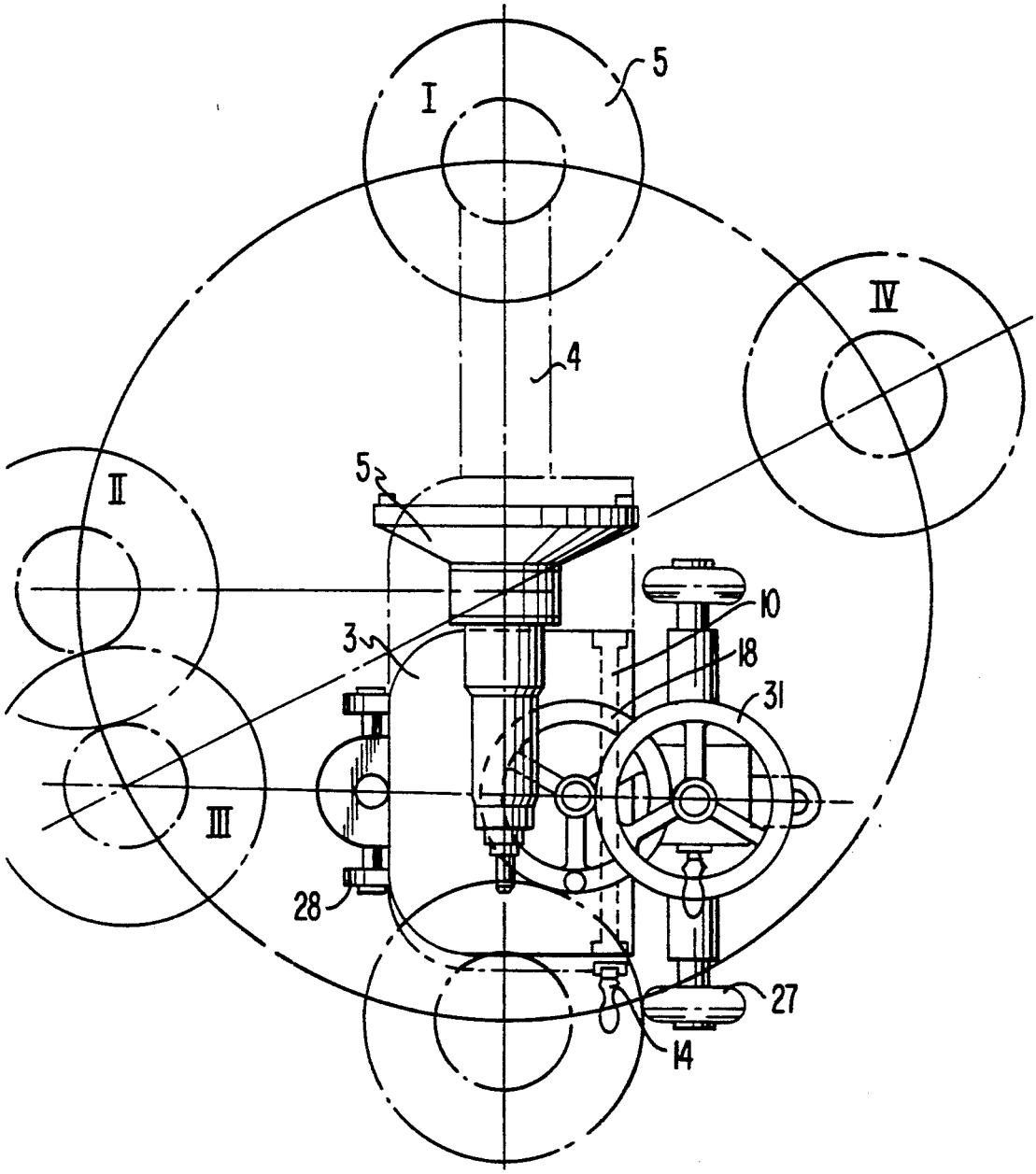
FIG. 7 is a top view of the universal abrader according to the present invention.

FIG. 7 is a schematic top view of the universal abrader of the present invention. In FIG. 7, solid lines show a state of grinding vertical surfaces, and dash-double dot lines show the possible motion orbit and positions I,II,III,IV, and V of the processing tool when the horizontal surfaces are worked after the headstock 3 has been turned through an angle of 90°. The limit positions of the motion are determined by the criterion that the rotatable arm 4 and processing tool should not touch the walking wheels 27 and the steering wheels 28. The limit positions can be predetermined by adjustment before operation, and position limiting switches may be used to limit the positions.

Figure 8:
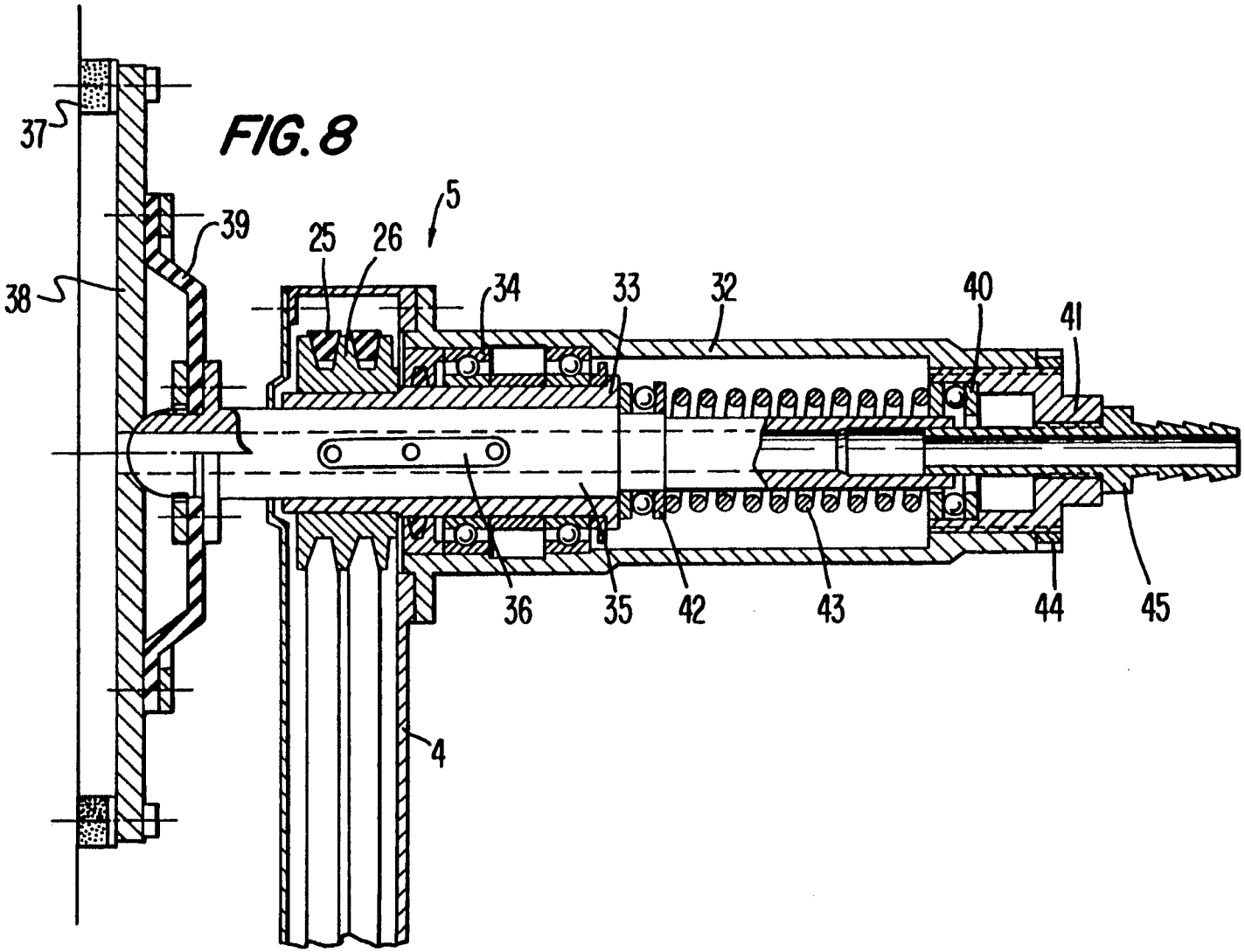
FIG. 8 is an enlarged axially sectional view of the processing tool assembly of the present invention.

Referring now to FIG. 8, processing tool assembly 5 comprises a casing 32 fixed on rotatable arm 4. In casing 32, a rotatable transmission shaft sleeve 33 is supported by an axial thrust ball bearing 34, and provided with the transmission belt pulley 26 thereon. A tool shaft 35 having central through hole in its axial direction is coupled with the shaft sleeve 33 by using a sliding key 36, so that shaft 35 can not only rotate together with but also slide relative to shaft sleeve 33. In this embodiment, a grinding head consisting of a grinding tool 37 and a grinding disk 38 is mounted at the front end of shaft 35 through a flexible shaft coupling 39 (it may be made of elastic material). The grinding tool 37 may be a plurality of diamond grinding wheels uniformly distributed on the periphery of grinding disk 38. The flexible shaft coupling 39 can perform flexible and universal transmission in a small range. At the rear end of shaft 35, there is an axial thrust ball bearing 40 having its fixed ring mounted in a threaded pressing cover 41 screwed in the rear portion of casing 32. Between shaft 35 and a moving ring of ball bearing 40, there is a sliding fit. Similarly, opposite to ball bearing 40, an axial thrust ball bearing 42, is mounted on the staged portion of shaft 35 near the middle of shaft 35. Between ball bearings 40 and 42, a compression spring 43 is disposed around shaft 35. The preset force of the compression spring 43, i.e. the preset working pressure of the grinding head, can be adjusted by turning the threaded pressing cover 41. The magnitude of the working pressure can be measured by the compressed rate of spring 43, and its value is indicated on the scale of a meter (not shown). After abovementioned adjustment, the pressing cover 41 is locked by a locking nut 44.

In this case, shaft 35 can not only rotate with a high speed but also shift under the action of compression spring 43, thus automatically adjusting feed rate and working pressure of the grinding tool. All this and the additional function of flexible and universal transmission provided by the flexible coupling 39 result in the appreciable reduction of the vibration and noise of the universal abrader of the present invention and great improvements of the working quality and efficiency.

A pipe connector 45 is plugged in the rear terminal of shaft 35 to form a sliding joint there between. The outer portion of pipe connector 45 is connected to a water source by a flexible pipe, for injecting the cooling water through the central through hole of shaft 35 to working surfaces for cooling and lubricating.

The operation of the universal abrader of the present invention will be described in detail as follows.

FIG. 1 shows that the universal abrade of the present invention is being used to grind the wall surface (i.e. vertical surface). When it is desired to grind the floor surface (i.e. horizontal surface), the handle 13 shown in FIG. 5 should be turned to enable worm 12 to rotate worm-gear 11, and hence, by pivot 8, the movable headstock 3 is rotated anticlockwise through an angle of 90° from the position shown in FIG. 1. Because of the worm and worm-gear mechanism having self-lock function, the movable headstock 3 can be positioned at any angle. It can be appreciated that, by using such worm and worm-gear mechanism, headstock 3 can be turned to an arbitrary angle in order to make the processing tool carried by rotatable arm 4 work on an surface which is to be processed and at any tilted possiton. During process of surfaces having various tilting positions, headstock 3 is brought into action by screw stem 10 rotated by turning handle 14, and occurs feed ovement in a direction perpendicular to the plane, in which, the precessing tool rotates. By turning handle 18 or starting the unshown electric motor for rotating worm 17, the processing tool can be carried to sweep over the surface to be processed by rotatable arm 4, and simultaneously by corresponding movement of the walking mechanism 2, the whole surface can be processed.

When a planar surface is to be cut, the grinding head and flexible coupling 39 must be demounted firstly, and a circular saw (not shown) is mounted on the front end of shaft 35. Then, handwheel 18 is turned or the unshown electric motor for rotating worm 17 is started to rotate the rotatable arm 4, until the cutting saw reaches the assigned position, as shown in FIG. 3. The abrader is now ready for cutting.

If the grinding head is changed into a cloth wheel, waxing and polishing processes can be carried out.

Additionally, it is convenient to use the universal abrader of the present invention to produce prefabricated surface-sticking slabs of terrazzo or artificial marble at the work site. The concrete procedures are as follows: dispose the frame mould; cast the concrete; after having been matured to reach a certain strength, the surface of the structural member of the concrete is grinded, and then is cut in accordance with the desired sizes.

In order to process small surfaces having special shapes, for example, the surfaces of windowsills, staircases, etc., as shown in FIG. 4, the universal abrader of the present invention is provided with some accessories of small electric tools including hand-held abraders 46 and 47, cutter 48, hole-borer 49 etc., the required electric power of which is supplied by the electric power distribution box in main body 1 of the abrader.

For the purpose of reducing the labor intensity of the operator during process of the large surface of a structural member, a seat 50 for being sat by the operator can be pulled behind and by the machine body 1, as shown in FIG. 2, so that the operator may operate following the abrader.

An electric control system of the universal abrader according to the present invention, which possesses manual and automatic control functions, is disposed in the main body 1. In the automatic control state, the abrader can walk and work automatically by using a computer and an infrared transmitting and receiving means.

What is claimed is:

1. A universal abrader for abrading surfaces of various architectural members and having various shapes and tilting positions, comprising:

a main body;

a movable headstock supported movably on said main body;

a totatable arm rotatively supported on said movable headstock;

a processing tool assembly mounted at the free end of said rotatable arm and carrying a rotatable processing tool;

a driving mechanism for rotating said processing tool;

a motion supporting mechanism for supporting said movable headstock on said main body and enabling said movable headstock with respect to said main body not only to rotate but also to displace in a direction perpendicular to a plane in which said processing tool rotates;

a rotation supporting mechanism for supporting said rotatable arm on said movable headstock; and a moving mechanism mounted under said main body, for moving said abrader on a supporting surface, wherein said motion supporting mechanism comprises a rotatable pivot for connecting said main body and said movable headstock, which at its one end extending into said headstock has an enlarged terminal head having a threaded hole therein perpendicular to the axis of said pivot, and a screw stem having its two ends mounted on a chassis of said headstock and engaged with said threaded hole, thus enabling said headstock relative to said main body not only to rotate around the axis of said pivot, but also to displace together with said screw stem in the axial direction of said screw stem by rotating said screw stem.

2. A universal abrader according to claim 1, wherein another end of said pivot, extending into said main body, is provided with a worm-gear engaged with a worm disposed inside said main body and rotated by a handle disposed outside said main body in order to bring said headstock into rotation through said worm-gear, said pivot, and said screw stem.

3. A universal abrader according to claim 2, wherein said processing tool assembly comprises a casing fixed on said rotatable arm, a rotatable transmission shaft sleeve mounted in said casing, a tool shaft mounted in said transmission shaft sleeve by using a sliding key, a processing tool mounted on the front end of said tool shaft, a compression spring for constantly biasing said tool shaft towards the processed surface, and a threaded pressing cover disposed at the rear portion of said casing, for adjusting the preset force of said spring.

4. A universal abrader according to claim 3, wherein said driving mechanism comprises an electric motor disposed in said movable headstock, a first belt transmission mechanism arranged in said movable headstock, an intermediate transmission shaft, and a second belt transmission mechanism disposed in said rotatable arm thus making said transmission shaft sleeve bring said tool shaft therein into rotation.

5. A universal abrader according to claim 4, wherein said rotation supporting mechanism comprises a rotatable shaft sleeve connected with the supported end of said rotatable arm and mounted around said intermediate transmission shaft, and said rotatable shaft sleeve being provided with a worm-gear engaged with a worm, so that said rotatable arm can be rotated together with said rotatable shaft sleeve by manually turning a handwheel connected to one end of said worm.

6. A universal abrader according to claim 5, wherein said tool shaft has a central through hole, from which the cooling water can be led to inject and thereby cool and lubricate the processed surface.

7. A universal abrader according to claim 6, wherein said processing tool is a grinding head consisting of a grinding disk mounted on the front end of said tool shaft by a flexible shaft coupling, and a plurality of diamond grinding wheels uniformly disposed on the periphery of said grinding disk.

8. A universal abrader according to claim 4, wherein said rotation supporting mechanism comprises a rotatable shaft sleeve connected with the supported end of said rotatable arm and mounted around said intermediate transmission shaft, and said rotatable shaft sleeve being provided with a worm-gear engaged with a worm, such that said rotatable arm can be rotated together with said rotatable shaft sleeve by actuating an electric motor connected to said worm.

* * * * *

UNITED STATES PATENT AND TRADEMARK OFFICE

CERTIFICATE OF CORRECTION

PATENT NO. : 5,142,826

DATED : September 1, 1992

INVENTOR(S) : Chaoyin Zhang

It is certified that error appears in the above-identified patent and that said Letters Patent is hereby corrected as shown below:

Column 6, line 38, change "totatable to --rotatable--.

Signed and Sealed this

Twelfth Day of October, 1993

*Attest:*

*Attesting Officer*

Bruce Lehman

BRUCE LEHMAN

*Commissioner of Patents and Trademarks*